US008023869B2

(12) United States Patent
Mizumoto et al.

(10) Patent No.: US 8,023,869 B2
(45) Date of Patent: Sep. 20, 2011

(54) CONDUCTIVE ROLLER WHICH IS MOUNTED ON AN IMAGE-FORMING MECHANISM OF AN ELECTROPHOTOGRAPHIC APPARATUS

(75) Inventors: Yoshihisa Mizumoto, Hyogo (JP); Masakazu Tanaka, Hyogo (JP); Takashi Marui, Hyogo (JP); Hideyuki Okuyama, Hyogo (JP); Noriaki Hitomi, Hyogo (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 0 days.

(21) Appl. No.: 12/580,830

(22) Filed: Oct. 16, 2009

(65) Prior Publication Data

US 2010/0172675 A1 Jul. 8, 2010

(30) Foreign Application Priority Data

Jan. 7, 2009 (JP) ..... 2009-001972

(51) Int. Cl.
*G03G 15/08* (2006.01)

(52) U.S. Cl. ..... 399/286

(58) Field of Classification Search ..... 399/279, 399/286

See application file for complete search history.

(56) References Cited

U.S. PATENT DOCUMENTS

2007/0243984 A1* 10/2007 Mizumoto ..... 492/49

FOREIGN PATENT DOCUMENTS

| | | | |
|---|---|---|---|
| JP | 2004-170845 | A | 6/2004 |
| JP | 2006-265413 | A | 10/2006 |
| JP | 2006-348245 | A | 12/2006 |

* cited by examiner

*Primary Examiner* — Hoang Ngo

(74) *Attorney, Agent, or Firm* — Birch, Stewart, Kolasch & Birch, LLP

(57) ABSTRACT

The present invention provides a conductive roller whose outermost layer is made of a vulcanized rubber composition. The vulcanized rubber composition contains epichlorohydrin rubber and chloroprene rubber as a rubber component thereof and 0.2 to 5 parts by mass of each of a thiourea-based vulcanizing agent and a vulcanization retarder consisting of N-(cyclohexylthio)phthalimide for 100 parts by mass of the rubber component.

8 Claims, 1 Drawing Sheet

CONDUCTIVE ROLLER WHICH IS MOUNTED ON AN IMAGE-FORMING MECHANISM OF AN ELECTROPHOTOGRAPHIC APPARATUS

This nonprovisional application claims priority under 35 U.S.C. §119(a) on Patent Application No(s). 2009-001972 filed in Japan on Jan. 7, 2009, the entire contents of which are hereby incorporated by reference.

BACKGROUND OF THE INVENTION

1. Field of the Invention

The present invention relates to a conductive roller and more particularly to a conductive roller which is used as a developing roller, a cleaning roller, a charging roller, a transfer roller, and the like to be mounted on an electrophotographic apparatus.

2. Description of the Related Art

In the printing technique using an electrophotographic method, improvements have been made for a high-speed printing operation, formation of a high-quality image, colorization, and miniaturization of an image-forming apparatus. Toner holds the key to these improvements. To satisfy the above-described demands, it is necessary to form finely divided toner particles, make the diameters of the toner particles uniform, and make the toner particles spherical. Regarding the technique of forming the finely divided toner particles, toner having a diameter not more than 10 μm and not more than 5 μm have been developed recently. Regarding the technique of making the toner spherical, toner having not less than 99% in its sphericity has been developed. To form the high-quality image, polymerized toner has come to be widely used instead of pulverized toner conventionally used. The polymerized toner allows the reproducibility of dots to be excellent in obtaining digital information as a printed sheet and hence a high-quality printed sheet to be obtained.

In compliance with the improvement in the technique of forming the finely divided toner particles, making the diameters of the toner particles uniform, making the toner particles spherical, and the shift from the pulverized toner to the polymerized toner, a conductive roller which imparts a high extent of charging property to toner and is capable of efficiently transporting the toner to a photosensitive drum is especially useful in an image-forming mechanism of an electrophotographic apparatus such as a laser beam printer, and the like. Users demand that the high-performance function of the conductive roller is maintained to the end of the life of a product.

A conductive rubber roller is proposed, as described in Japanese Patent Application Laid-Open No. 2004-170845 (patent document 1). The conductive roller is composed of the conductive rubber which contains the dielectric loss tangent-adjusting filler for adjusting the dielectric loss tangent thereof to 0.1 to 1.5. The conductive rubber roller is capable of imparting a proper and high extent of charging property to toner, thereby providing a high-quality initial image. In the conductive rubber roller, the charged amount of the toner little decreases even after printing of images on a considerable number of sheets finishes. Consequently the conductive rubber roller keeps providing a high-quality image for a long time.

In the embodiment which is the specific form of the invention, only the epichlorohydrin rubber which is the ionic-conductive rubber is used. Thus toner has an insufficient extent of charging property. Further because the compression set is not less than 5%, the conductive rubber roller is not sufficiently resistant to load.

Such being the case, it is necessary to impart a proper degree of charging property to toner and improve the resistance to load by decreasing the compression set so that the conductive rubber roller can be used for a long period of time.

In the developing roller, when the toner has a low extent of charging property, it is impossible to transport a sufficient amount of toner. On the other hand, when the toner has a high extent of charging property, it is impossible to transport the toner to a photosensitive drum having an opposite electric charge by a static electricity (Coulomb force). Therefore it is important to impart a proper extent of charging property to the toner. In a toner box, the developing roller is rubbed by a flat plate called a developing blade with the developing roller being strongly compressed by the developing blade. Therefore the developing roller is demanded to strain to a possible lowest extent when it is compressed by the developing blade. When a printer is compact because of colorization, the developing roller is demanded to be compact and have a construction which can be compressed to a high extent. Therefore the developing roller is required to have a low degree of strain against the compression.

PRIOR ART DOCUMENT

Patent Document

Patent document 1: Japanese Patent Application Laid-Open No. 2004-170845

SUMMARY OF THE INVENTION

The present invention has been made in view of the above-described problems. It is an object of the present invention to provide a conductive roller which is excellent in processability, capable of imparting a proper degree of charging property to toner, has a low compression set so that conductive roller is prevented from being strained owing to contact between conductive roller and other members so that conductive roller can be used for a long time.

To solve the above-described problems, the present invention provides a conductive roller whose outermost layer is made of a vulcanized rubber composition. The vulcanized rubber composition contains epichlorohydrin rubber and chloroprene rubber as a rubber component thereof and 0.2 to 5 parts by mass of each of a thiourea-based vulcanizing agent and a vulcanization retarder consisting of N-(cyclohexylthio) phthalimide for 100 parts by mass of the rubber component.

The present inventors' have investigated the invention described in the above-described patent document. As a result, they have found that vulcanization has been hitherto carried out by using mainly sulfur from the standpoint of the stability in processability and mechanical characteristic, but there are many cases in which the vulcanization performed by using sulfur does not provide a sufficient vulcanization density and in some cases, there is a variation in the vulcanization density owing to conditions of vulcanization temperature and the like and that this causes an insufficient compression set to be obtained.

Based on the above-described knowledge, the present inventors' have made investigations by trial-and-error and found that by using the thiourea-based vulcanizing agent as a vulcanizing agent and setting the mixing amount thereof to 0.2 to five parts by mass for 100 parts by mass of the rubber component, the epichlorohydrin rubber and the chloroprene rubber are crosslinked in short bonds, and thereby it is possible to increase the vulcanizing density and greatly reduce the compression set.

But when the thiourea-based vulcanizing agent is used as the vulcanizing agent, there arises a problem that storage stability (scorch) is short and thus processability lowers. As a result of the present inventors' investigation to solve the problem, they succeeded in achieving the desired processability and compression set by using the N-(cyclohexylthio)phthalimide as the vulcanization retarder and by mixing 0.2 to 5 parts by mass thereof for 100 parts by mass of the rubber component.

The vulcanized rubber composition composing the outermost layer of the conductive roller contains the epichlorohydrin rubber and the chloroprene rubber as its rubber component. The mixing ratio between the epichlorohydrin rubber and the chloroprene rubber is not limited to a specific mixing ratio, but favorably the epichlorohydrin rubber:the chloroprene rubber=1:9 to 9:1 and more favorably 3:7 to 7:3. When the mixing ratio of any one of the epichlorohydrin rubber and the chloroprene rubber is smaller than the above-described mixing ratio, it is difficult to obtain the characteristic to be obtained by using the epichlorohydrin rubber or the chloroprene rubber.

The vulcanized rubber composition may contain NBR, EPDM as its rubber component.

The vulcanized rubber composition contains 0.2 to 5 parts by mass of the thiourea-based vulcanizing agent for 100 parts by mass of the rubber component.

When the mixing amount of the thiourea-based vulcanizing agent is less than 0.2 parts by mass, the vulcanization density does not increase and it is difficult to improve the compression set. As the addition amount of the thiourea-based vulcanizing agent is increased to make the vulcanization density higher, the electric resistance value can be increasingly lowered. Thus when the mixing amount of the thiourea-based vulcanizing agent is less than 0.2 parts by mass, it is difficult to lower the electric resistance value. On the other hand, when the mixing amount of the thiourea-based vulcanizing agent is more than five parts by mass, the thiourea-based vulcanizing agent blooms from the conductive roller, thus contaminating a photosensitive drum and greatly deteriorating the mechanical properties of the conductive roller such as a breaking elongation.

The vulcanized rubber composition contains 0.2 to 5 parts by mass of the vulcanization retarder consisting of the N-(cyclohexylthio)phthalimide for 100 parts by mass of the rubber component.

When the mixing amount of the vulcanization retarder is less than 0.2 parts by mass, it is difficult to improve the processability. On the other hand, when the mixing amount of the vulcanization retarder is more than five parts by mass, the vulcanization retarder blooms from the conductive roller, thus contaminating the photosensitive drum and greatly deteriorating the mechanical properties of the conductive roller such as the breaking elongation.

The conductive roller of the present invention has at least an outermost layer made of the vulcanized rubber composition described above. The conductive roller of the present invention may be composed of one rubber layer, made of the vulcanized rubber composition, composing the outermost layer thereof or two or more rubber layers made of different compositions. It is preferable to compose the conductive roller of only one layer made of the vulcanized rubber composition from the standpoint of production efficiency, because the conductive roller composed of one layer can be produced in a simple process.

The conductive roller of the present invention normally has a hollow portion in which a cylindrical core is fitted by press fit.

It is preferable to form an oxide film on the surface of the outermost layer by irradiating the surface thereof with ultraviolet rays.

Because the oxide film can be promptly formed at a low cost by irradiating the surface of the outermost layer with the ultraviolet rays, it is preferable to form the oxide film by irradiating the surface of the outermost layer with the ultraviolet rays. By forming the oxide film, it is possible to lower the friction coefficient of the surface of the conductive roller and decompose a residue of the vulcanization retarder. Further the oxide film serves as a dielectric layer, thereby decreasing the dielectric loss tangent of the conductive roller. Consequently it is possible to efficiently apply charging property to the toner and maintain the charging property applied thereto. The oxide film may be formed by other known way such as an ozone exposure, and the like.

It is preferable to use the conductive roller of the present invention for image-forming mechanisms of electrophotographic apparatuses of office automation appliances such as a laser beam printer, an ink jet printer, a copying machine, a facsimile, an ATM, and the like.

It is especially preferable to use the conductive roller for a toner transport part of a developing roller, a toner supply roller, a cleaning roller, a charging roller, a transfer roller, and the like for transporting unmagnetic one-component toner and members, of the image-forming mechanisms, that contact the toner. In this case, because the outermost layer is made of the vulcanized rubber composition, it is possible to easily obtain the uniformity of the electrical property of the conductive roller and repeated reproducibility of design values at a low cost.

The conductive roller of the present invention is preferably used as the developing roller used for a developing device, using the unmagnetic one-component toner, which is mounted on the image-forming mechanism of the electrophotographic apparatus. The developing method to be carried out in the image-forming mechanism of the electrophotographic apparatus is classified into a contact type and a non-contact type in terms of the relation between the photosensitive drum and the developing roller. The conductive roller of the present invention can be utilized for both types. It is preferable that the conductive roller of the present invention is in contact with the photosensitive drum when the conductive roller is used as the developing roller.

The effect of the present invention is described below. The conductive roller of the present invention contains the epichlorohydrin rubber and the chloroprene rubber as the rubber component thereof and 0.2 to 5 parts by mass of each of the thiourea-based vulcanizing agent and the vulcanization retarder consisting of the N-(cyclohexylthio)phthalimide for 100 parts by mass of the rubber component. Therefore the conductive roller of the present invention has the compression set as small as not more than 5% and thus can be prevented from being strained owing to the contact between the conductive roller and other members under pressure. Therefore the conductive roller is capable of displaying a stable performance for a long time.

The conductive roller of the present invention is capable of imparting a proper degree of charging property to the toner. Consequently when the conductive roller of the present invention is used as the developing roller, the developing roller keeps providing a proper degree of a print density.

The conductive roller of the present invention has the scorch time $t_5$ not less than five and improved processability. Therefore extrusion molding and injection molding can be easily performed. Thereby the conductive roller has improved molding accuracy such as outer diameter accuracy and a decrease in the surface roughness.

Because the conductive roller of the present invention contains the epichlorohydrin rubber, the electric resistance value thereof can be easily adjusted to a predetermined one. In addition, because the epichlorohydrin rubber does not have a double bond in its main chain, the conductive roller has improved resistance to weather, ozone, heat, and chemicals. Further because the conductive roller contains the epichlorohydrin rubber, it has an improved strength.

DETAILED DESCRIPTION OF THE PREFERRED EMBODIMENTS

Figure 1:
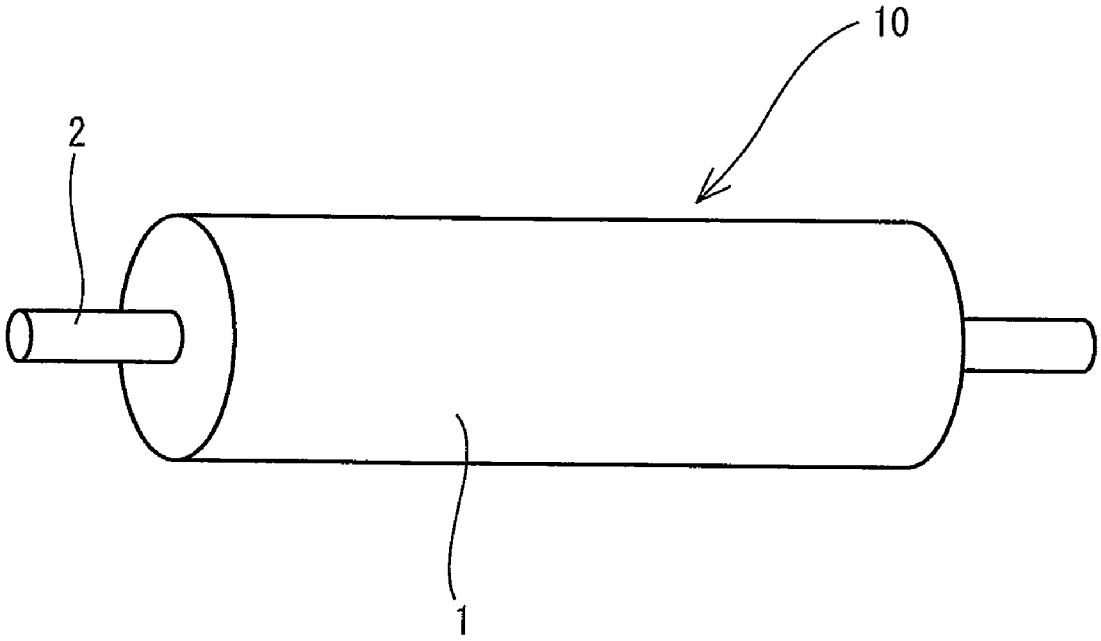
FIG. 1 is schematic view showing a conductive roller of the present invention.

The embodiments of the present invention are described below.

As shown in FIG. 1, a conductive roller 10 has one cylindrical rubber layer 1. A columnar core (shaft) 2 is inserted into a hollow portion of the rubber layer 1 by press fit. The rubber layer 1 and the core 2 are bonded to each other with an adhesive agent.

The rubber layer 1 has a thickness of 0.5 mm to 15 mm and favorably 3 to 15 mm. The reason the thickness of the rubber layer 1 is set to 0.5 mm to 15 mm is as follows: If the thickness thereof is less than 0.5 mm, it is difficult to obtain an appropriate nip. If the thickness thereof is more than 15 mm, the rubber layer 1 is so large that it is difficult to produce a small and lightweight developing roller. The surface layer of the rubber layer 1 is oxidized by irradiating the surface layer with ultraviolet rays to form an oxide film thereon.

The core 2 is made of a metal such as aluminum, an aluminum alloy, SUS or iron or ceramics, and the like.

The rubber layer 1 is made of a vulcanized rubber composition.

The vulcanized rubber composition contains (A) epichlorohydrin rubber and (B) chloroprene rubber as its rubber component. The mixing ratio therebetween is preferably 1:1.

As the epichlorohydrin copolymers, it is possible to list epichlorohydrin homopolymer, an epichlorohydrin (EP)-ethylene oxide (EO) copolymer, an epichlorohydrin (EP)-propylene oxide (PO) copolymer, an epichlorohydrin (EP)-allyl glycidyl ether (AGE) copolymer, an epichlorohydrin (EP)-ethylene oxide (EO)-allyl glycidyl ether (AGE) copolymer, an epichlorohydrin (EP)-propylene oxide (PO)-allyl glycidyl ether (AGE) copolymer, and an epichlorohydrin (EP)-ethylene oxide (EO)-propylene oxide (PO)-allyl glycidyl ether (AGE) copolymer.

As the epichlorohydrin copolymer, of the above-described copolymers, it is preferable to use the epichlorohydrin (EP)-ethylene oxide (EO) copolymer, the epichlorohydrin (EP)-ethylene oxide (EO)-allyl glycidyl ether (AGE) copolymer, and the epichlorohydrin (EP)-allyl glycidyl ether (AGE) copolymer.

It is more favorable that the epichlorohydrin copolymer contains the ethylene oxide. The epichlorohydrin copolymer contains the ethylene oxide at not less than 30 mol % nor more than 95 mol %, favorably not less than 55 mol % nor more than 95 mol %, and more favorably not less than 60 mol % nor more than 80 mol %. The ethylene oxide has a function of decreasing the volume resistivity value. But when the content of the ethylene oxide is less than 30 mol %, the ethylene oxide has a low effect of decreasing the volume resistivity value. When the content of the ethylene oxide is more than 95 mol %, the ethylene oxide crystallizes and the segment motion of the molecular chain thereof is prevented from taking place. Consequently the volume resistivity value tends to rise and in addition the hardness of the vulcanized rubber and the viscosity of the rubber before vulcanization are liable to rise.

As the epichlorohydrin copolymer, it is especially preferable to use the epichlorohydrin (EP)-ethylene oxide (EO) copolymer. The content ratio between the EO and the EP in the copolymer (EO:EP) is set to favorably 30-80 mol %:20 to 70 mol % and more favorably 50-80 mol %:20 to 50 mol %.

It is also possible to preferably use the epichlorohydrin (EP)-ethylene oxide (EO)-allyl glycidyl ether (AGE) copolymer. The content ratio among the EO, the EP, and the AGE in the epichlorohydrin copolymer (EO:EP:AGE) is set to favorably 30 to 95 mol %:4.5 to 65 mol %:0.5 to 10 mol % and more favorably 60 to 80 mol %:15 to 40 mol %:2 to 6 mol %.

The mixing amount of the epichlorohydrin copolymer for the total mass, namely, 100 parts by mass of the rubber component is not less than one part by mass and less than 100 parts by mass, favorably not less than five parts by mass, more favorably not less than 10 parts by mass, and most favorably not less than 30 parts by mass.

The chloroprene rubber is a polymer of chloroprene and produced by emulsion polymerization thereof. In dependence on the kind of a molecular weight modifier, the chloroprene rubber is classified into a sulfur-modified type and a non-sulfur-modified type.

The chloroprene rubber of the sulfur-modified type is formed by plasticizing a polymer resulting from polymerization of sulfur and the chloroprene with thiuram disulfide or the like to adjust the resulting chloroprene rubber of the sulfur-modified type to a predetermined Mooney viscosity. The chloroprene rubber of the non-sulfur-modified type includes a mercaptan-modified type and a xanthogen-modified type. Alkyl mercaptans such as n-dodecyl mercaptan, tert-dodecyl mercaptan or octyl mercaptan is used as a molecular weight modifier for the mercaptan-modified type. An alkyl xanthogen compound is used as a molecular weight modifier for the xanthogen-modified type.

In dependence on a crystallization speed of the generated chloroprene rubber, the chloroprene rubber is classified into an intermediate crystallization speed type, a low crystallization speed type, and a high crystallization speed type.

The chloroprene rubber of both the sulfur-modified type and the non-sulfur-modified type can be used in the present invention. But it is preferable to use the chloroprene rubber of the non-sulfur-modified type having the low crystallization speed.

The mixing amount of the chloroprene rubber for the total mass, namely, 100 parts by mass of the rubber component is selected in the range of not less than 1 and less than 100 parts by mass. In view of the effect of imparting charging property to the toner, the mixing amount of the chloroprene rubber is set to favorably not less than five parts by mass for 100 parts by mass of the rubber component. To make the rubber uniform, the mixing amount of the chloroprene rubber is set to more favorably not less than 10 parts by mass and most favorably not more than 30 parts by mass for 100 parts by mass of the rubber component.

The vulcanized rubber composition contains a (C) thiourea-based vulcanizing agent as a vulcanizing agent.

As the thiourea-based vulcanizing agent, it is possible to list tetramethylthiourea, trimethylthiourea, ethylenethiourea, and thioureas shown by $(C_nH_{2n+1}NH)_2C{=}S$ (n=integers 1 to 10). It is preferable to use the ethylenethiourea.

The mixing amount of the thiourea-based vulcanizing agent for 100 parts by mass of the rubber component is set to not less than 0.2 parts by mass nor more than five parts by mass, and favorably not less than 0.5 nor more than five parts by mass, and more favorably not less than 0.5 nor more than three parts by mass.

The vulcanized rubber composition contains the vulcanization retarder consisting of the (D) N-(cyclohexylthio)phthalimide.

As the vulcanization retarder, it is possible to use phthalic anhydride, N-nitrosodiphenylamine, and 2,4-diphenyl-4-methyl-1-pentene. The N-(cyclohexylthio)phthalimide is used in the present invention.

The mixing amount of the vulcanization retarder for 100 parts by mass of the rubber component is set to 0.2 to 5 parts by mass, favorably 0.5 to 5 parts by mass, and more favorably 0.5 to 3 parts by mass.

In addition to the above-described components, the vulcanized rubber composition may appropriately contain the following components unless the use thereof is not contradictory to the object of the present invention.

As the other components, vulcanized rubber composition may contain a vulcanization accelerator, a vulcanization accelerating assistant, an acid-accepting agent, a filler, a softening agent, a deterioration prevention agent, an ultraviolet ray absorber, a lubricant, a pigment, an antistatic agent, a fire retarding agent, a neutralizing agent, a core-forming agent, a foaming agent, a foam prevention agent. But it is preferable that the vulcanized rubber composition does not contain the softening agent to prevent the toner and other members such as the photosensitive drum from being contaminated to even a light extent by bleeding. When the vulcanized rubber composition contains an antioxidant, it is preferable to appropriately select the mixing amount thereof to allow the progress of the formation of the oxide film to be formed on the surface thereof.

In dependence on the kind of the vulcanizing agent, the vulcanization accelerator or the vulcanization accelerating assistant may be added to the rubber component, as described above.

As the vulcanization accelerator, it is possible to use inorganic accelerators such as slaked lime, magnesia (MgO), and litharge (PbO); and organic accelerators shown below. The organic accelerator includes guanidines such as di-ortho-tolylguanidine, 1,3-diphenyl guanidine, 1-ortho-tolylbiguanide, di-ortho-tolylguanidine salts of dicatechol borate; thiazoles such as 2-melcapto-benzothiazole, dibenzothiazolyl disulfide; sulfinamides such as N-cyclohexyl-2-benzothiazolylsulfinamide; thiurams such as tetramethylthiuram monosulfide, tetramethylthiuram disulfide, tetraethylthiuram disulfide, and dipentamethylenethiuram tetrasulfide; and thioureas. It is possible to use the above-described organic accelerators singly or in combination.

The mixing amount of the vulcanization accelerator for 100 parts by mass of the rubber component is set to favorably not less than 0.1 nor more than five parts by mass and more favorably not less than 0.3 nor more than three parts by mass.

The following vulcanization accelerating assistants can be used: metal oxides such as zinc white; fatty acids such as stearic acid, oleic acid, cotton seed fatty acid, and the like; and known vulcanization accelerating assistants.

The addition amount of the vulcanization accelerating assistant for 100 parts by mass of the rubber component is set to favorably not less than 0.5 parts by mass nor more than 10 parts by mass and more favorably not less than two parts by mass nor more than eight parts by mass.

Because the vulcanized rubber composition contains the epichlorohydrin rubber having chlorine atoms, it is preferable to add an acid-accepting agent to the epichlorohydrin rubber. Thereby it is possible to prevent a chlorine gas generated when the rubber is vulcanized from remaining and the other members from being contaminated.

As the acid-accepting agent, it is possible to use various substances acting as acid acceptors. As the acid-accepting agent, hydrotalcites or magnesium oxide can be favorably used because they have preferable dispersibility. The hydrotalcites are especially favorable. By using the hydrotalcites in combination with a magnesium oxide or a potassium oxide, it is possible to obtain a high acid-accepting effect and securely prevent the other members from being contaminated.

The mixing amount of the acid-accepting agent for 100 parts by mass of the rubber component is set to favorably not less than 1 nor more than 10 parts by mass and more favorably not less than one nor more than five parts by mass. The mixing amount of the acid-accepting agent for 100 parts by mass of the rubber component is set to favorably not less than one part by mass to allow the acid-accepting agent to effectively display the effect of preventing inhibition of vulcanization and the other members from being contaminated. The mixing amount of the acid-accepting agent for 100 parts by mass of the rubber component is set to favorably not more than 10 parts by mass to prevent an increase of the hardness of the vulcanized rubber composition.

As the filler, it is possible to list powdery fillers such as zinc oxide, silica, carbon, carbon black, clay, talc, calcium carbonate, magnesium carbonate, and aluminum hydroxide. It is possible to improve the mechanical strength and the like of the rubber composition containing the filler.

The addition amount of the filler for 100 parts by mass of the rubber component is set to favorably not more than 60 parts by mass, more favorably not more than 50 parts by mass, and most favorably not more than 30 parts by mass.

In the present invention, carbon black having a small particle diameter not less than 18 nm and less than 80 nm is defined as "highly conductive carbon black". Carbon black having a large particle diameter not less than 80 nm and less than 500 nm is defined as "weakly conductive carbon black" clearly distinguished from the highly conductive carbon black in the particle diameter. In the present invention, it is possible to use either "highly conductive carbon black" or "weakly conductive carbon black".

There is a conspicuous difference between the conductivity of the carbon black having a particle diameter not less than 80 nm and the carbon black having a particle diameter less than 80 nm. The highly conductive carbon black and the weakly conductive carbon black have a different role when they are contained in the vulcanized rubber composition. That is, the weakly conductive carbon black has a large particle diameter and its structure has developed to a low extent, thus contributing to the conductivity of the conductive roller to a low extent. By containing the weakly conductive carbon black in the conductive roller, it is possible to obtain a capacitor-like operation owing to a polarization effect without increasing the conductivity hereof and control the charging property thereof without damaging uniformity of the electric resistance thereof. On the other hand, the highly conductive carbon black has a smaller particle diameter than the weakly conductive carbon black and its structure has developed to a high extent, thus contributing to the conductivity of the conductive roller to a high extent. Therefore by containing the highly conductive carbon black in the conductive roller, it is possible to enhance the conductivity thereof. In using the conductive roller as a developing roller, it is possible to obtain a high print density even though the developing roller contacts a photosensitive drum in a short period of time because the printer is operated at a high speed and even though the developing roller contacts the photosensitive drum in a small area because the printer is compact and hence the diameter of the photosensitive drum is small.

It is preferable to use the "highly conductive carbon black" having the small particle diameter not less than 18 nm and less than 80 nm. When the carbon black whose particle diameter is less than 18 nm is used, it cannot be uniformly dispersed in the vulcanized rubber composition. Thus the toner transport amount is nonuniform at portions where the carbon black is non-uniformly dispersed. Thereby there is a fear that a defective image is generated and that the toner-sealing part of the conductive roller is broken, which causes the toner to leak.

The method of producing the conductive roller 10 shown in FIG. 1 is described below.

After components to be contained in the vulcanized rubber composition are kneaded by using a mixing apparatus such as a kneader, a roller, a Banbury mixer or the like, the components are preformed tubularly by using a rubber extruder. Thereafter the preform is vulcanized.

An optimum vulcanizing time period should be set by using a vulcanization testing rheometer (for example, Curelasto meter). To prevent the conductive roller from contaminating the other members and decrease the degree of the compression set, it is preferable to set conditions in which a possible largest vulcanization amount is obtained. More specifically, the vulcanization temperature is set to favorably 100 to 220° C. and more favorably 120 to 180° C. The vulcanization time period is set to favorably 15 to 120 minutes and more favorably 30 to 90 minutes.

After the step of vulcanizing the preform finishes, the core 2 is inserted into the hollow portion of the preform and bonded thereto. After the preform is cut to a necessary size, the surface of the rubber layer 1 is abraded to a mirror-like surface finish. The surface roughness Rz of the abraded rubber layer 1 is set to 0.1 to 3.0 μm.

After the roller is abraded, the roller is washed with water. Thereafter an oxide film is formed on the surface of the rubber layer 1 as desired. In forming the oxide film, the surface of the roller is irradiated with ultraviolet rays (wavelength: 184.9 nm and 253.7 nm) at intervals of 90 degrees in the circumferential direction of the roller for five minutes with an ultraviolet ray irradiation lamp spaced at 10 cm from the roller. The roller is rotated by 90 degrees four times to form the oxide film on the entire peripheral surface (360 degrees) of the roller.

It is preferable that the conductive roller 10 of the present invention produced in the above-described method has the following properties.

It is preferable that a compression set Cs is not more than 5% when the compression set is measured at a compression ratio of 25%, a measuring temperature of 70° C., and a measuring period of time of 24 hours in accordance with the provision of JIS K6262 specifying "Method of examining the permanent set of vulcanized rubber and thermoplastic rubber".

It is preferable that a scorch time $t_5$ is not less than five when the scorch time $t_5$ is measured at a measuring temperature of 130° C. in accordance with the provision of JIS K6300-1 specifying "Method of finding a viscosity and a scorch time by using a Mooney viscometer" by using an L-type rotor.

It is preferable that the toner charged amount measured in the method described in the example described later is 30 to 50 (μC/g).

Example and Comparison Example

The components (numerical values shown in table 1 indicate part by mass) shown in table 1 were kneaded by using a Banbury mixer. Thereafter the kneaded components were extruded by a rubber extruder to obtain a tube of each of the examples and the comparison examples having an outer diameter of ϕ22 mm and an inner diameter of ϕ9 mm to ϕ9.5 mm. Each tube was mounted on a shaft having a diameter of ϕ8 mm for vulcanizing use. After the rubber component was vulcanized in a vulcanizing can for one hour at 160° C., the tube was mounted on a shaft, having a diameter of ϕ10 mm, to which a conductive adhesive agent was applied. The tube and the shaft were bonded to each other in an oven at 160° C. After the ends of the tube were cut, traverse abrasion was carried out by using a cylindrical abrading machine. Thereafter the surface of the tube was abraded to a mirror-like surface finish. The surface roughness Rz of the tube was set to the range of 3 to 5 μm. The surface roughness Rz was measured in accordance with JIS B 0601 (1994). As a result, a conductive roller of each of the example and the comparison example having a diameter of ϕ20 mm (tolerance: 0.05) was obtained.

In evaluating the compression set, the same lot of the vulcanized rubber composition as that of the vulcanized rubber composition which underwent extrusion molding was extracted. In accordance with the provision of JIS K6300, the extracted vulcanized rubber composition was pressed into a configuration at 160° C. for 60 minutes so that the vulcanized rubber composition was measured in its compression set. Thereby a specimen of each of the examples and the comparative examples was obtained.

After the surface of each of the conductive rollers was washed with water, the surface thereof was irradiated with ultraviolet rays to form an oxide film thereon. By using an ultraviolet ray irradiation lamp ("PL21-200" produced by SEN LIGHTS CORPORATION), the surface of each conductive roller was irradiated with ultraviolet rays (wavelength: 184.9 nm and 253.7 nm) at intervals of 90 degrees in its circumferential direction for five minutes with the ultraviolet ray irradiation lamp spaced at 10 cm from the conductive roller. The conductive roller was rotated by 90 degrees four times to form the oxide film on its entire peripheral surface (360 degrees).

TABLE 1

| | Comparison Example 1 | Comparison Example 2 | Comparison Example 3 | Comparison Example 4 | Comparison Example 5 | Comparison Example 6 | Example 1 |
|---|---|---|---|---|---|---|---|
| Epichlorohydrin rubber (ECO) | 50 | | | 50 | 50 | 50 | 50 |
| Epichlorohydrin rubber (GECO) | | 100 | 100 | | | | |
| Chloroprene rubber | 50 | | | 50 | 50 | 50 | 50 |
| Hydrotalcite | 3 | 3 | 3 | 3 | 3 | 3 | 3 |
| Zinc oxide | 5 | 5 | 5 | 5 | 5 | 5 | 5 |

TABLE 1-continued

| | | | | | | | |
|---|---|---|---|---|---|---|---|
| Carbon black (120 nm) | 15 | 15 | 15 | 15 | 15 | 15 | 15 |
| Vulcanizing agent 1 | 0.5 | 1.5 | | | | | |
| Vulcanization accelerator 1 | 0.5 | 1.5 | | | | | |
| Vulcanization accelerator 2 | 0.17 | 0.5 | | | | | |
| Vulcanizing agent 2 | 1.33 | | 2 | 2 | 0.1 | 5.3 | 2 |
| Vulcanization accelerator 3 | 1.13 | | 1.7 | 1.7 | 1.7 | 1.7 | 1.7 |
| Vulcanization retarder | | | | | 1 | 1 | 0.2 |
| Compression set (%) | 6 | 28 | 4.5 | 2.6 | 2.6 | 5.3 | 2.6 |
| Scorch time | 7 | 9 | 4.2 | 4.2 | 4.3 | 6.8 | 5.3 |
| Electrostatic property | 40 | 25 | 25 | 40 | 41 | 40 | 41 |
| Test for examining whether mark of blade was printed | Δ | X | ○ | ○ | ○ | Δ | ○ |
| Synthetic | Δ | Δ | X | X | X | Δ | ◎ |

| | Example 2 | Example 3 | Example 4 | Example 5 | Example 6 | Example 7 | Example 8 |
|---|---|---|---|---|---|---|---|
| Epichlorohydrin rubber (ECO) | 50 | 50 | 90 | 10 | 50 | 50 | 50 |
| Epichlorohydrin rubber (GECO) | | | | | | | |
| Chloroprene rubber | 50 | 50 | 10 | 90 | 50 | 50 | 50 |
| Hydrotalcite | 3 | 3 | 3 | 3 | 3 | 3 | 3 |
| Zinc oxide | 5 | 5 | 5 | 5 | 5 | 5 | 5 |
| Carbon black (120 nm) | 15 | 15 | 15 | 15 | 15 | 15 | 15 |
| Vulcanizing agent 1 | | | | | | | |
| Vulcanization accelerator 1 | | | | | | | |
| Vulcanization accelerator 2 | | | | | | | |
| Vulcanizing agent 2 | 2 | 2 | 2 | 2 | 0.5 | 3 | 4.5 |
| Vulcanization accelerator 3 | 1.7 | 1.7 | 1.7 | 1.7 | 0.4 | 2.7 | 1.7 |
| Vulcanization retarder | 5 | 1 | 1 | 1 | 1 | 1 | 1 |
| Compression set (%) | 3.5 | 2.4 | 2.6 | 2.7 | 3.5 | 2.7 | 2.1 |
| Scorch time | 6.5 | 6 | 6 | 6 | 6.1 | 5.7 | 5.1 |
| Electrostatic property | 34 | 40 | 32 | 49 | 41 | 41 | 40 |
| Test for examining whether mark of blade was printed | ○ | ○ | ○ | ○ | ○ | ○ | ○ |
| Synthetic | ○ | ◎ | ○ | ○ | ○ | ○ | Δ |

As the components of the conductive roller of each of the examples 1 through 8 and the comparison examples 1 through 6, the following substances were used:

(a) Rubber Component

Chloroprene rubber (CR): "Shoprene WRT" produced by Showa Denko K.K.

Epichlorohydrin copolymer (ECO): "Epichlomer D" produced by DAISO CO., LTD.

EO(ethylene oxide)/EP(epichlorohydrin)=61 mol %/39 mol %]

Epichlorohydrin copolymer (GECO): "Epion ON301" produced by DAISO CO., LTD.

EO(ethylene oxide/EP(epichlorohydrin)/AGE(allyl glycidyl ether)=73 mol %/23 mol %/4 mol %

(b) Acid-Accepting Agent

Hydrotalcite ("DHT-4A-2" produced by Kyowa Chemical Industry Co., Ltd.)

(c) Filler

Zinc oxide: two kinds of zinc oxide (produced by Mitsui Mining and Smelting Co., Ltd.)

Carbon black ("Denka Black" produced by Denki Kagaku Kogyo K. K., average particle diameter: 35 nm)

(d) Vulcanizing Agent and Vulcanization Accelerator

Vulcanizing agent 1: Sulfur (powdery sulfur produced by Tsurumi Chemical Industry Co., Ltd.)

Vulcanization accelerator 1: dibenzothiazolyl sulfide ("Nocceler DM" produced by Ouchishinko Chemical Industrial Co., Ltd.)

Vulcanization accelerator 2: tetramethylthiuram monosulfide ("Nocceler TS" produced by Ouchishinko Chemical Industrial Co., Ltd.)

Vulcanizing agent 2: Ethylene thiourea ("Axel 22-S" produced by KAWAGUCHI CHEMICAL INDUSTRY CO., LTD.)

Vulcanization accelerator 3: di-ortho-tolylguanidine ("Nocceler DT" produced by Ouchishinko Chemical Industrial Co., Ltd.)

(e) Vulcanization Retarder

N-(cyclohexylthio)phthalimide ("Retarder CTP" produced by Toray Industries Inc.)

The following properties of the conductive roller of each of the examples and the comparison examples were measured. Results are shown in the table 1.

<Measurement of Compression Set>

In accordance with the provision of JIS K6262 specifying "Method of examining the permanent set of vulcanized rubber and thermoplastic rubber", the compression set of each specimen, for measuring the compression set, which was prepared in the above-described manner was measured at a measuring temperature of 70° C., a measuring period of time of 24 hours, and a compression ratio of 25%. More specifically, a compression strain corresponding to 25% of the thickness of the cylindrical specimen was applied thereto. The specimen was kept at 70° C. for 24 hours. Thereafter the thickness thereof was measured after elapse of 30 minutes after it was taken out of a compression apparatus. A compression set Cs (%) can be computed from obtained values by using an equation shown below:

$$Cs(\%)=\{(t_0-t_2)/(t_0-t_1)\}\times 100$$

where $t_0$, $t_1$, and $t_2$ indicate an original thickness (mm) of the specimen, the thickness (mm) of a spacer, and the thickness (mm) of the specimen after the elapse of 30 after the specimen was taken out of the compression apparatus respectively.

The compression set means a permanent strain of a rubber material owing to heating and compression. The smaller the value of the compression set is, the higher a restoring force is when it is compressed for a long time. Generally the higher the compression ratio and the test temperature are, the larger the permanent strain is. When the compression set percentage Cs (%) is not more than 5% in the condition of the measurement thereof, the specimen sufficiently satisfies the performance demanded for members used for an image-forming mechanism such as a developing roller.

<Measurement of Scorch Time>

In accordance with the provision of JIS K6300-1 specifying "Method of finding the viscosity and the scorch time by using a Mooney viscometer", the scorch time $t_5$ was measured at a measuring temperature of 130° C. by using the L-type rotor. The scorch time was evaluated in terms of a time $t_5$ in which the reading of a Mooney viscometer rose by 5M from a minimum value Vm of the Mooney viscosity with respect to the time when a die was closed. The shorter the scorch time $t_5$ is, the lower the extrusion processability is. More specifically, when the scorch time $t_5$ is less than five, the specimen has a low extrusion processability and hence a low practicability.

<Evaluation of Charging Property>

The conductive roller of each of the examples and the comparison examples was mounted on a laser printer (commercially available printer in which the positively charged unmagnetic one-component toner was used, print speed: 24 sheets/minute, and recommended number of sheets which can be printed with toner: 7000 sheets) as a developing roller thereof. After 1% printing was performed on 100 sheets of paper, black solid images was printed. After a white solid image (blank) was printed on a 102nd sheet of paper, a cartridge was removed from the laser printer to suck toner from the developing roller mounted on the cartridge by using a charged amount-measuring machine of a sucking type ("Q/M METER Model 210HS-2" produced by Trek Inc.) so that the charged amount (μC) was measured. Based on the following equation, the toner charged amount (μC/g) was computed from obtained values.

$$\text{Toner charged amount}(\mu C/g)=\text{Charged amount}(\mu C)/\text{Weight of toner}(g)$$

In order for the laser printer to provide a preferable toner transport performance, the toner charged amount is preferably 30 to 50 (μC/g).

<Test for Examining Whether Mark of Blade Was Printed>

After the cartridge used to evaluate the charging property was left in an oven having a temperature of 50° C. and a humidity of 55% for 24 hours, the cartridge was mounted on the laser printer again to output a 50% half-tone image. Whether a mark formed on the surface of the developing roller by being compressed with a blade was outputted in an image was visually checked. Developing rollers which caused the mark of the blade to be clearly printed was marked by X. Developing rollers which caused the mark of the blade to be slightly printed was marked by Δ. Developing rollers which caused the mark of the blade to be unprinted was marked by ○.

<Synthetic Evaluation>

◎: Developing rollers which had favorable processability and did not cause the mark of the blade to be printed, excellent practicability, and favorable charging property and hence allowed a high-quality image to be provided.

○: Developing rollers which had favorable processability and did not cause the mark of the blade to be printed and hence had excellent practicability.

Δ: Developing rollers which caused the mark of the blade to be printed (compression set is more than five), but had favorable processability. Thus in dependence on a machine-setting manner, there is a possibility that the developing rollers can be practically used.

X: Because developing rollers had bad processability, they are nonpracticable.

When the scorch times of developing rollers are less than five, processability (extrusion molding) thereof is low and mass production thereof cannot be performed. Thus these developing rollers were marked by X.

What is claimed is:

1. A conductive roller consisting of one layer that is made of a vulcanized rubber composition, said vulcanized rubber composition consists of epichlorohydrin rubber and chloroprene rubber as a rubber component thereof, and 0.2 to 5 parts by mass of a thiourea-based vulcanizing agent for 100 parts by mass of said rubber component.

2. The conductive roller according to claim 1, wherein a compression set measured at a measuring temperature of 70° C., a measuring period of time of 24 hours, and a compression ratio of 25% in accordance with the provision of JIS K6262 is not more than 5%; and a scorch time $t_5$ measured at a measuring temperature of 130° C. in accordance with the provision of JIS K6300-1 is not less than five by using an L-type rotor.

3. The conductive roller according to claim 1 used as a developing roller for use in a developing device, using an unmagnetic one-component toner, which is mounted on an image-forming mechanism of an electrophotographic apparatus.

4. The conductive roller according to claim 2 used as a developing roller for use in a developing device, using an unmagnetic one-component toner, which is mounted on an image-forming mechanism of an electrophotographic apparatus.

5. The conductive roller according to claim 1 having a hollow portion in which a cylindrical core is fitted and an oxide film formed on a surface of an outermost layer thereof by irradiating said surface of said outermost layer with ultraviolet rays.

6. The conductive roller according to claim 2 having a hollow portion in which a cylindrical core is fitted and an oxide film formed on a surface of an outermost layer thereof by irradiating said surface of said outermost layer with ultraviolet rays.

7. The conductive roller according to claim 3 having a hollow portion in which a cylindrical core is fitted and an oxide film formed on a surface of an outermost layer thereof by irradiating said surface of said outermost layer with ultraviolet rays.

8. The conductive roller according to claim 4 having a hollow portion in which a cylindrical core is fitted and an oxide film formed on a surface of an outermost layer thereof by irradiating said surface of said outermost layer with ultraviolet rays.

* * * * *